US005540284A

United States Patent [19]

Esposito et al.

[11] Patent Number: 5,540,284

[45] **Date of Patent: * Jul. 30, 1996**

[54] PORTABLE FIRE FIGHTING TOOL

[75] Inventors: John Esposito, Barnegat; Norman E. Atwater, Jackson, both of N.J.

[73] Assignee: Augustus Fire Tool™, Island Heights, N.J.

[ * ] Notice: The term of this patent shall not extend beyond the expiration date of Pat. No. 5,409,067.

[21] Appl. No.: 382,162

[22] Filed: Feb. 1, 1995

Related U.S. Application Data

[63] Continuation-in-part of Ser. No. 155,213, Nov. 22, 1993, abandoned, and Ser. No. 203,039, Feb. 28, 1994, Pat. No. 5,409,067 Apr. 25, 1995.

[51] Int. Cl.[6] ..... A62C 3/07

[52] U.S. Cl. ..... 169/62; 169/70; 169/74

[58] Field of Search ..... 169/62, 70, 71, 169/74; 239/552

[56] References Cited

U.S. PATENT DOCUMENTS

| | | | |
|---|---|---|---|
| 1,377,431 | 5/1921 | Pfeil | 169/70 |
| 1,756,582 | 4/1930 | Butler | 169/70 |
| 1,758,119 | 5/1930 | La Moon | 239/552 |
| 2,413,083 | 12/1948 | Snowden et al. | 169/70 |
| 2,756,829 | 7/1956 | Phillips . | |
| 2,813,753 | 11/1957 | Roberts | 169/70 |
| 2,967,570 | 1/1961 | Nurkiewicz | 169/70 |
| 3,045,761 | 7/1962 | Carilo | 169/70 |
| 3,140,720 | 9/1963 | Sullivan | 169/70 |
| 4,219,084 | 8/1980 | Gray et al. | 169/70 |
| 4,625,808 | 12/1986 | Halfpenny | 169/70 |
| 4,676,319 | 6/1987 | Cuthbertson | 169/70 |
| 4,697,740 | 10/1987 | Ivy | 169/70 |
| 4,802,535 | 2/1989 | Bakke | 169/70 |
| 5,062,486 | 11/1991 | McClenahan | 169/62 |
| 5,253,716 | 10/1993 | Mitchell | 169/70 |

*Primary Examiner*—Gary C. Hoge
*Attorney, Agent, or Firm*—Stephen W. White

[57] ABSTRACT

A portable, hand-held fire fighting tool that can be connected by a hose to a large source of fire extinguishing agent is described. This tool comprises a hollow, penetrating body having a sharp, removable cutting element connected thereto. This body is then connected to a hollow, linear handle and the angle formed between a longitudinal line drawn through the body and the handle forms an angle of between 45° to 135°. At the end of the handle opposite to that attached to the penetrating body element, a hose connection device is located. When this is connected to a hose, and the hose then connected to a large source of fire extinguishing agent (e.g. a fire truck or fire hydrant, for example) the fire extinguishing agent can flow through the handle and penetrating body and out over the sharp, removable cutting element attached thereto. This tool is particularly useful in fighting fires contained within confined spaces such as those embodied by mobile homes, motor homes, truck trailers, small buildings and the like.

11 Claims, 6 Drawing Sheets

PORTABLE FIRE FIGHTING TOOL

This invention is a continuation-in-part of our previously filed applications U.S. application Ser. No. 08/155,213, filed Nov. 23, 1993 (now abandoned) and U.S. application Ser. No. 08/203,039, filed Feb. 28, 1994 now U.S. Pat. No. 5,409,067, issued on Apr. 25, 1995.

BACKGROUND OF THE INVENTION

1. Field of the Invention

This invention relates to the field of fire fighting and specifically to a portable, hand-held tool usable by one person to fight fires and even more specifically to a portable, hand-held tool that can be used in the fighting of fires contained within confined spaces and the like. Still more specifically, this invention relates to a portable, hand-held fire fighting tool that can be quickly and easily connected, using a hose line, to a large supply and large volume of fire fighting extinguishing agent and delivered to and through said tool under pressure by a piece of fire apparatus such as a booster tank pumper vehicle or fire hydrant.

2. Description of the Prior Art

There are a number of prior art instruments that are described as useful in fighting fires contained within a building. One of these is a large, spear-like element that is akin to a battering ram. This device is used by several fire fighters for penetrating walls, ceilings and roofs of buildings. The device is connected by a hose to a fire fighting extinguishing agent. After penetrating the building causing a large hole therein, the fire fighting extinguishing agent flows through the hose and into the interior of the building helping to extinguish any fire contained therein. The problem with this and other devices offered by the prior art is that they require more than one fire fighter to function and additionally are difficult and clumsy to haul about the scene of fires contained within confined areas, for example. In addition, these prior art devices cause a large hole to be made in the structure and this hole can permit oxygen and drafts to enter, enlarging the fire.

In our previously filed applications mentioned above, we describe a portable, hand-held fire fighting tool that can be used in fighting fires contained within a vehicle such as a car or truck. This device is designed to be used by a single fire fighter and is connectable with a quick connection device to portable sources of fire extinguishing agent such as that contained within a fire extinguisher, for example. Within the specification and file of U.S. application Ser. No. 08/203,039, filed Feb. 28, 1994 and allowed Dec. 28, 1994 there are a number of other references which describe fire fighting instruments or tools and those references are incorporated herein by reference. All of these prior art devices fail in a number of ways to operate within the metes and bounds of this invention. For example, our portable fire fighting tool of U.S. application Ser. No. 08/203,039, filed Feb. 28, 1994 and allowed Dec. 28, 1994 cannot be connected to a larger source of fire extinguishing agent and thus is useful only to fight smaller fires contained within a vehicle. Other prior art elements fail for other reasons such as clumsiness or lack of portability, for example. Still other prior art elements are cumbersome or have a host of complicated parts and devices which render them difficult to use in fighting fires within confined spaces.

SUMMARY OF THE INVENTION

It is an object of this invention to provide a simple, portable, hand-held device that can be used with any conventional high volume fire extinguishing agent to assist in the fighting of fires contained within a closed or confined spaces or areas. It is also an object of this invention to provide a simple, portable, hand-held fire fighting device that can be used by a single fire fighter. Another object of this invention is to provide a simple, portable, hand-held fire fighting device usable by a single fire fighter in the fighting of fires contained within the aforementioned confined spaces such as that embodied by trailers, sheds, motor homes, shipping containers and the like. These and yet other objects are achieved in a portable, hand-held fire tool comprising a hollow, linear handle element having two ends, the first end having a hose connection attached thereto and the other end being connected to a penetrating body element, said body element comprising a head with a hollow interior tapering down to a flared end, said flared end having a sharp, removable cutting element attached thereto, said cutting element comprising a shaft insertable and connectable within said tapered and flared end, and a cutting tip having a beveled top and a sharp point extending out from said shaft, wherein when a line is drawn through the longitudinal axis of said penetrating element, said line forms an angle of 45° to 135° to said handle element, said shaft of said cutting element having a series of flutes therein and said hollow, tapered and flared end of said body having a series of grooves therein, said flutes in said shaft of said cutting element forming a series of holes emanating from the top of said cutting tip when said cutting element is mated to said flared and tapered end of said hollow body of said head by inserting said shaft therein, said holes providing openings to the hollow interior of said penetrating body element, the hollow portion of said penetrating body element being connected to said hollow handle element permitting a flow through said handle to the interior of said penetrating element and wherein said hollow handle has a diameter of at least one half inches.

In yet another embodiment the linear handle element has a length of from between 30 inches to 50 inches, will form an angle of from 45° to 135° to a line drawn through the longitudinal axis of said penetrating body element and said handle will have a bend therein, said bend being formed at a distance of between 5 inches to 15 inches from said penetrating element, said bend forming an angle of 155° to 175°.

BRIEF DESCRIPTION OF THE DRAWINGS

FIG. 2 shows the portable, hand-held fire fighting device of this invention connected by a hose to a large source of fire extinguishing agent contained in a tank in or on fire apparatus or the like.

DETAILS OF THE DRAWINGS

Figure 1:
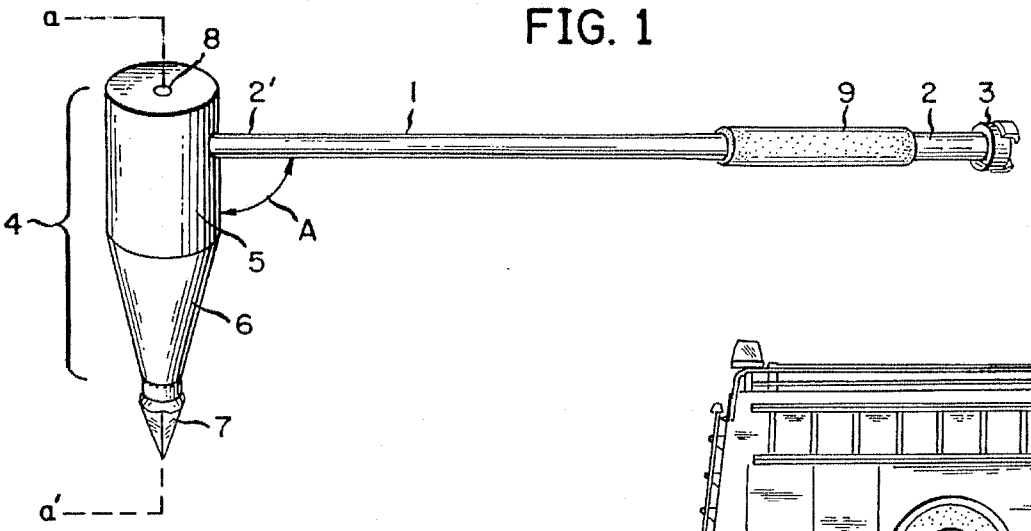
FIG. 1 is an overall side view of the portable, hand-held fire fighting device of this invention when un-connected to any source of fire extinguishing agent.

Referring now specifically to the drawings which show some particularly useful details and preferred embodiments of this invention, FIG. 1 is an overall side view of the portable, hand-held fire fighting device of this invention prior to being connected to a large source of fire extinguishing agent. In this FIG. 1 is a hollow, linear handle having two ends 2 and 2'. On end 2 there will be a hose connection element 3. End 2' is connected to a body element 4. The body element comprises a head 5 and a tapered portion 6. A sharp, removable cutting element 7 is shown at the end of the tapered portion 6. An attaching means for the cutting element 7 is shown at 8. In this particular mode, the attaching means is a long, threaded bolt which travels down through the hollow head and into the shaft of the cutting element 7. None of this is visible in this particular showing. The bolt may be of a flush or recessed type. An optional grip 9 is shown down near end 2 of the linear, hollow handle. In this particular mode, the angle A between the line formed by the handle 1 and a line a—a' formed when drawn through the longitudinal axis of body 5, will be 90°.

Figure 2:
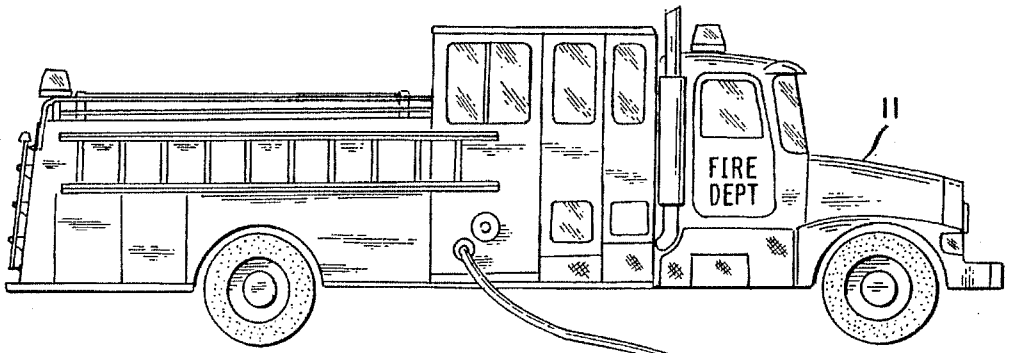
Figure 2:
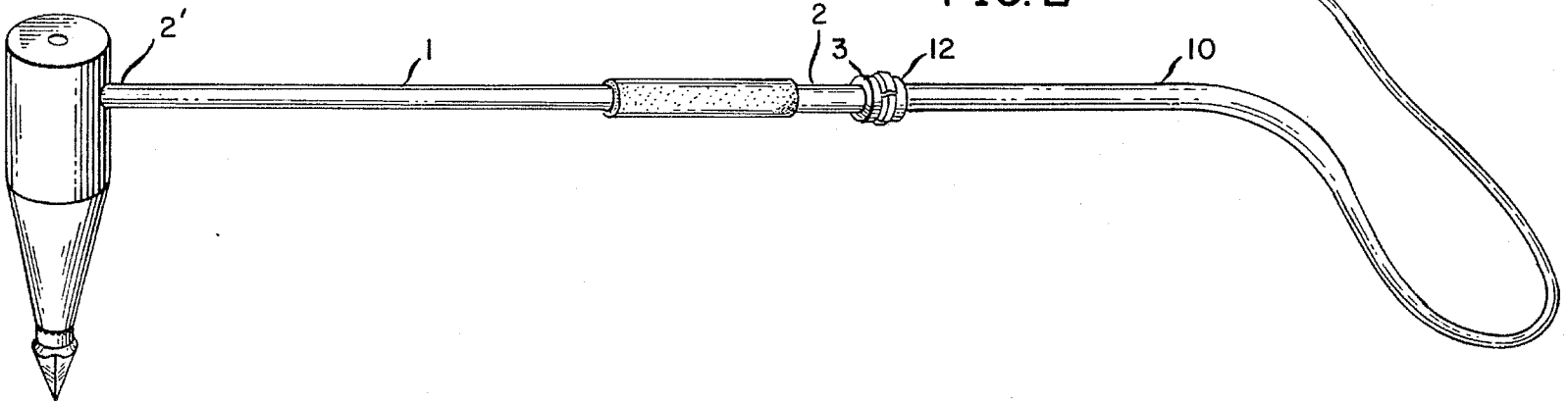

FIG. 2 shows the portable, hand-held fire fighting device of FIG. 1 connected by a hose 10 to a large source of fire fighting agent. In this particular showing, this source is depicted as that contained in the booster tank of a fire truck 11. The hose is connected to the hose connection element 3 on end 2 of the hollow, linear handle element 1 with a mating connection 12.

Figure 3:
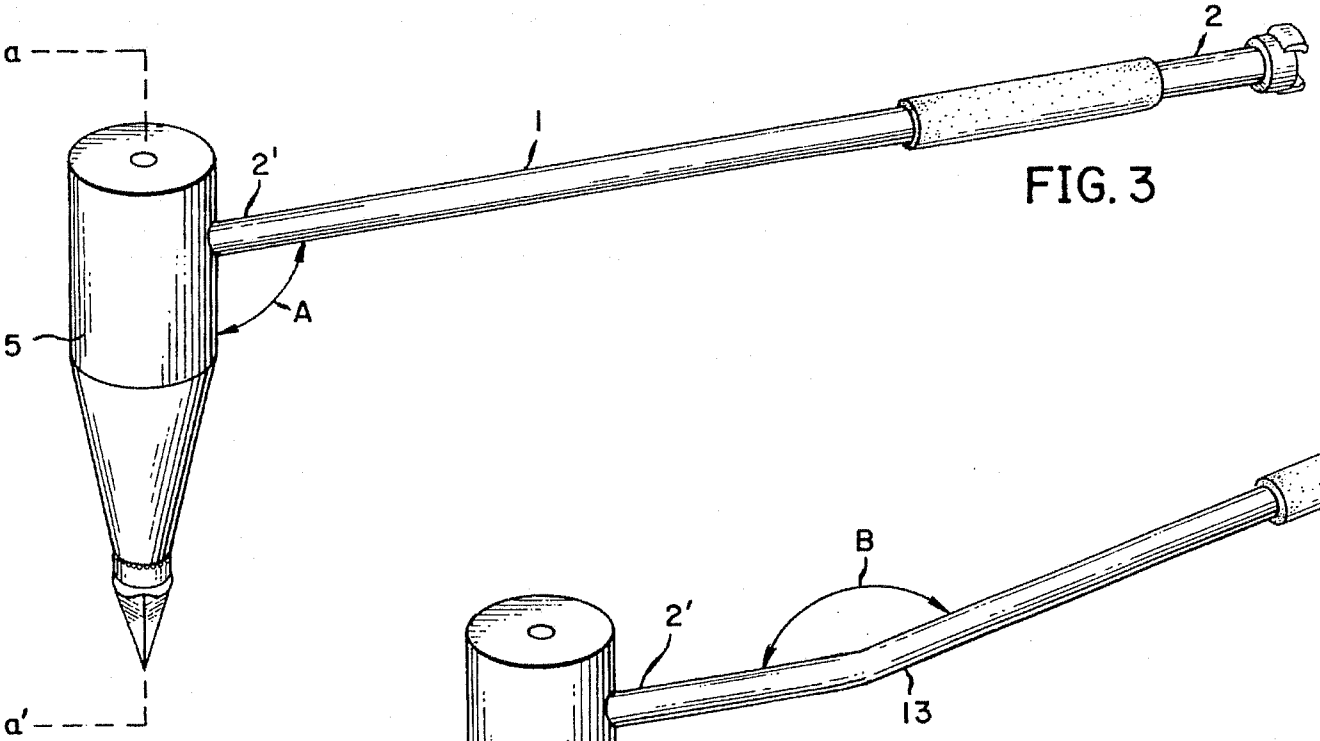
FIG. 3 is an overall side view of the portable, hand-held fire fighting device of this invention, un-connected to any source of fire extinguishing agent, and wherein the handle is at a different angle than that shown in FIG. 1.
Figure 4:
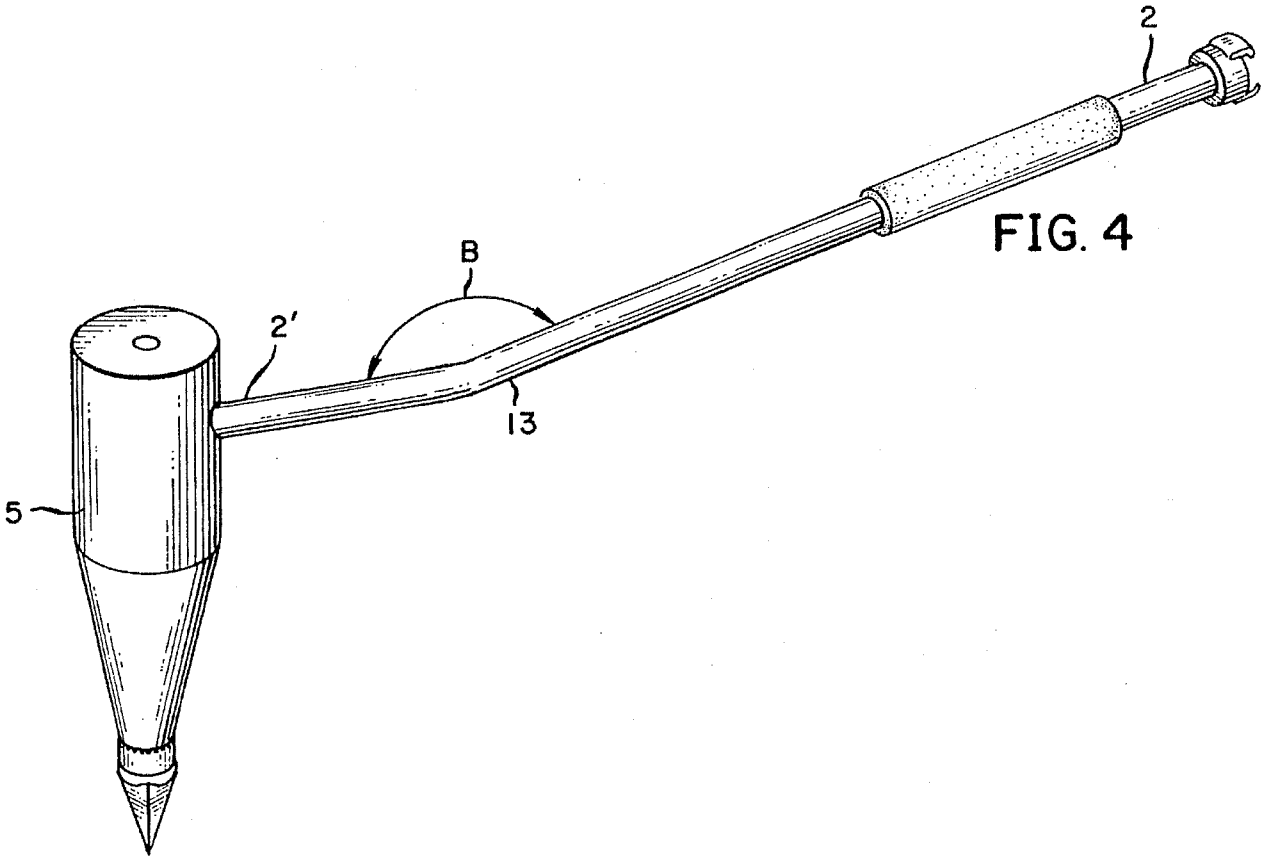
FIG. 4 is similar to FIG. 3 but wherein the handle contains a bend therein.

FIGS. 3 and 4 show alternative embodiments of the connection of the handle 1 to the head element 5. In FIG. 3 the angle A which is formed between the handle 1 and a line a—a' formed when drawn through the longitudinal axis of body 4 is between 45° to 135° and the length of the handle between ends 2 and 2' is between 30 inches to 50 inches.

In FIG. 4, the handle of FIG. 3 has a slight bend at 13. This bend forms an angle B of between 175° to 155° and may be located at a distance of between 5 to 15 inches from end 2'.

Figure 5:
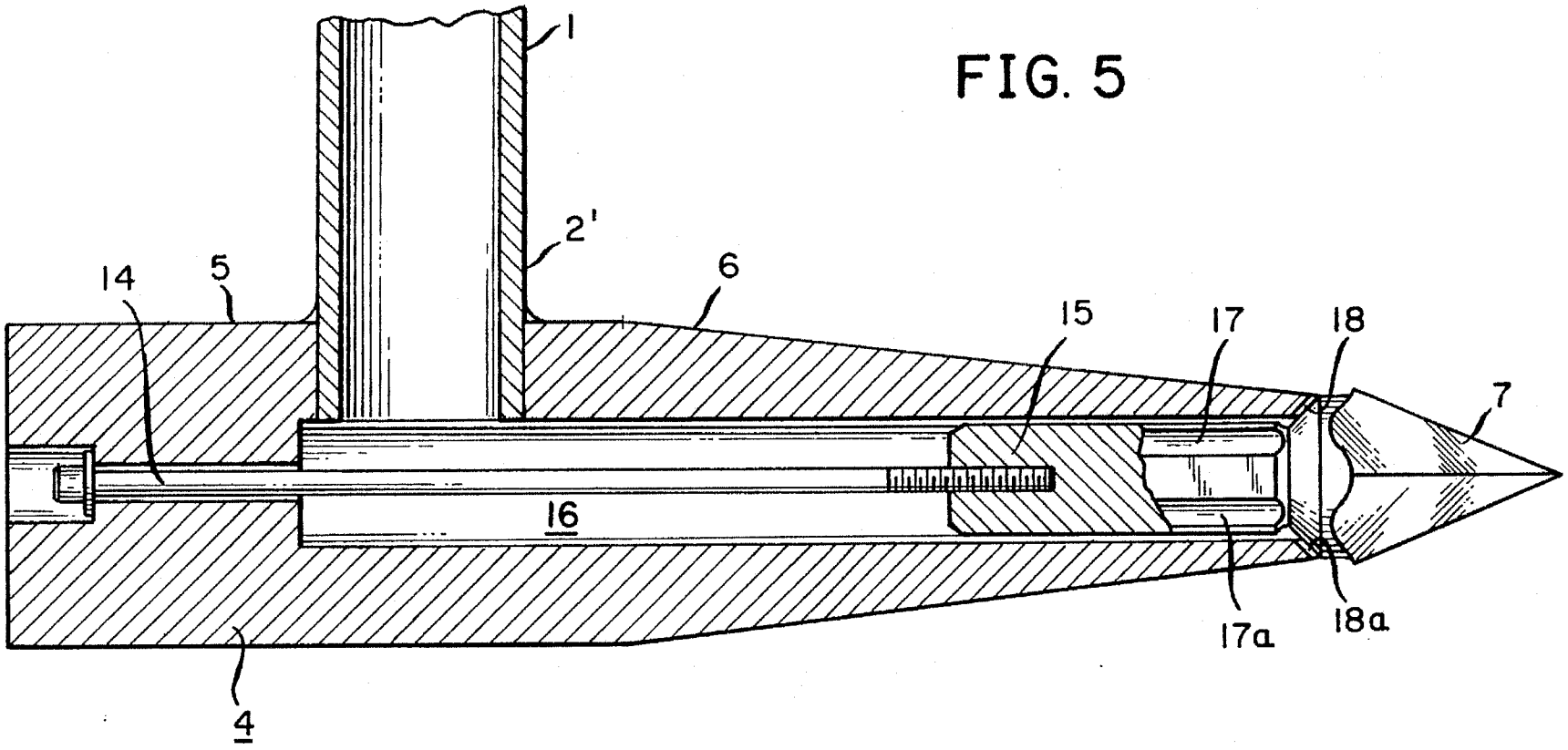
FIG. 5 is a detailed showing of the penetrating body and cutting element of FIGS. 1 and 2.

FIG. 5 is a more detailed showing of the body element 4. In this figure, the hollow, linear handle 1 is shown attached by welding at 2' to the body 4. The attaching means 14 for the cutting element 7 is shown as a recessed bolt down through the hollowed portion of body 4 and tapered portion 6 in to shaft 15 of the removable cutting element 7. The hollow portion of the head 5 and the handle 1 is shown as 16. Also seen in this figure are two flutes 17 and **17*a* of the cutting element 7. Additional flutes (not seen in this showing) may also be present and are so preferred. A series of grooves are also present within the tapered end of body element 4 but these are not shown in this figure. Holes shown by 18 and 18*a* will thus be formed when the cutting element 7 is properly mounted in the tapered and flared end 6 of body element 4**. It is through these holes that the fire extinguishing agent will be discharged in an umbrella-like fashion to fight the fire.

Figure 6:
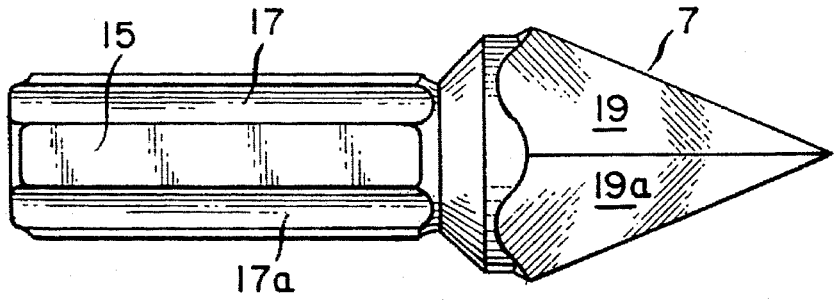
FIG. 6 is a detailed showing of the sharp, removable cutting element removed from the tapered and flared end of the body element.

FIG. 6 is a showing of the details of the removable, penetrating cutting element 7. In this showing, two faces 19 and **19*a* of the cutting element are shown. It is preferred that there be four such faces, although more or less are certainly an option. In this figure, however, only two can be seen. Flutes 17 and 17*a* formed in shaft 15 will permit the fire extinguishing agent to flow down through the body element and out holes formed when the flutes mate with grooves in the tapered end 6** (not shown in this embodiment).

Figure 7:
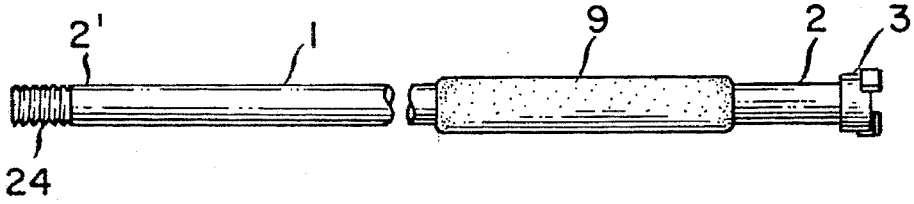
FIG. 7 is a detailed showing of the linear handle of FIG. 1 with details of the attaching means (threaded) to the head on one end and a mode of hose connection on the other end.

FIG. 7 shows the handle element of FIGS. 1 and 2. In this figure, the hollow handle element 1 is shown in cut away fashion. An optional grip 9 is also shown. The hose connection 3 is shown mounted on end 2. End 2' is shown threaded as 24 in this particular embodiment. When connected to a body element (not shown here), there will be a matching threaded opening to receive such a connection.

Figure 8:
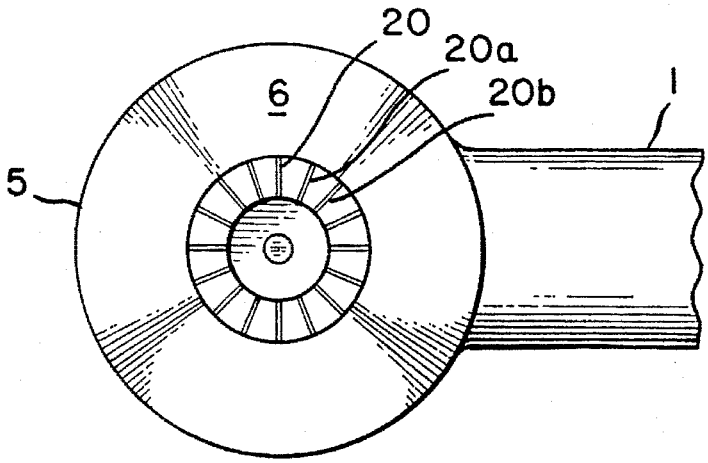
FIG. 8 is a detailed upward showing through the tapered and flared end of the penetrating body element of FIG. 1 of this invention after the sharp, cutting element has been removed. In this showing, the hollow interior and grooves contained therein can also be seen.

FIG. 8 is a showing looking up through the tapered end 6 in to an opening left by removing the cutting element therefrom. In this view, several grooves 20, **20*a*, 20*b*, et seq. are seen placed within the tapered and flared end 6**. These grooves will mate with the flutes in the cutting element and form discharge holes when the two are connected.

Figure 9:
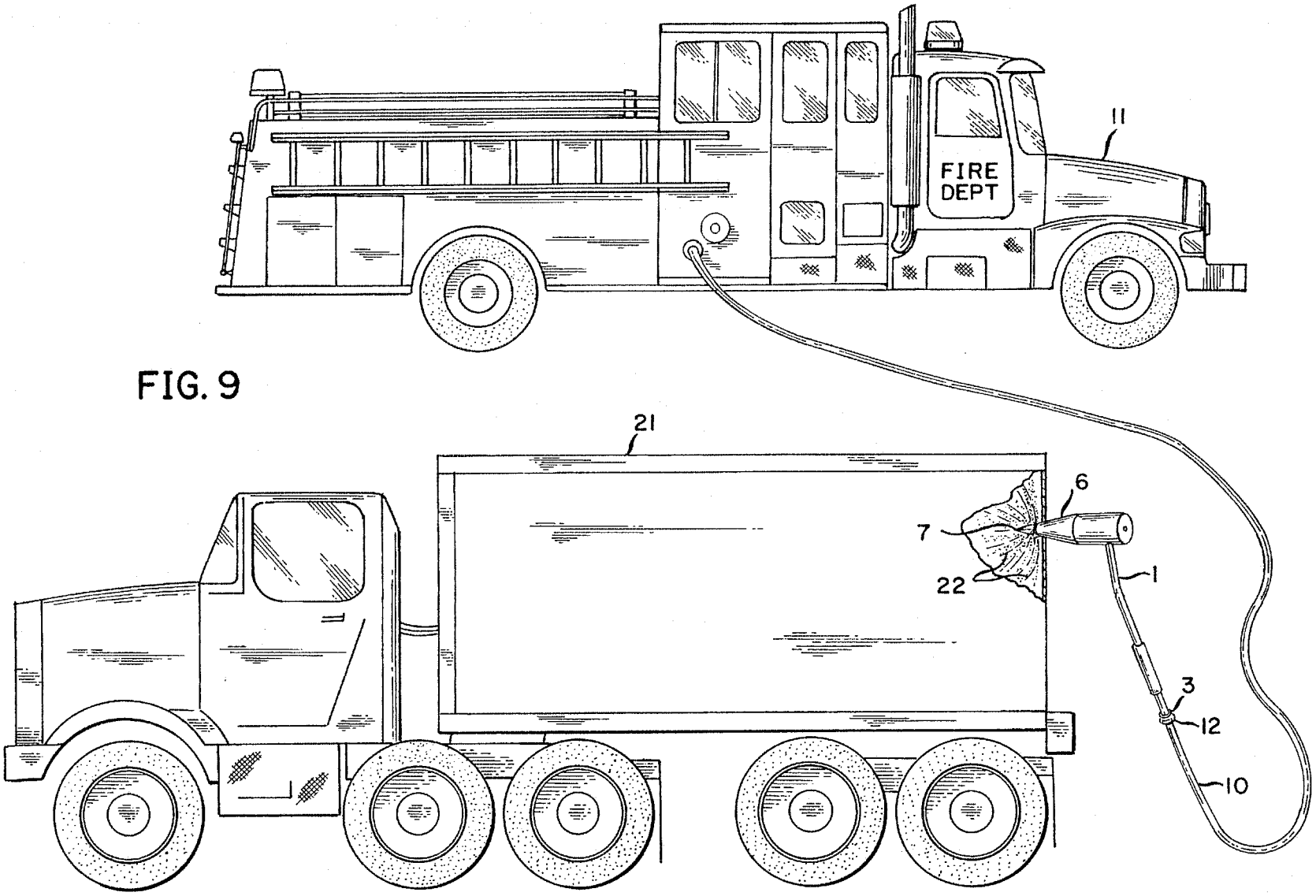
FIG. 9 is a showing of the portable, hand-held fire fighting device of this invention, fully connected by hose to a large source of fire extinguishing agent and being used to combat a fire contained within a truck trailer.

FIG. 9 is a showing of the element as described in FIG. 4 being used to fight a fire contained within a truck trailer. In this showing, the cutting element 7 and a portion of tapered end 6 has pierced the rear end of the trailer 21 (which may also be a mobile home, motor home or shipping container, for example) and the fire extinguishing agent is discharged therefrom in an umbrella like fashion to extinguish the fire. This agent is shown as 22 but the fire is not seen.

Figure 10:
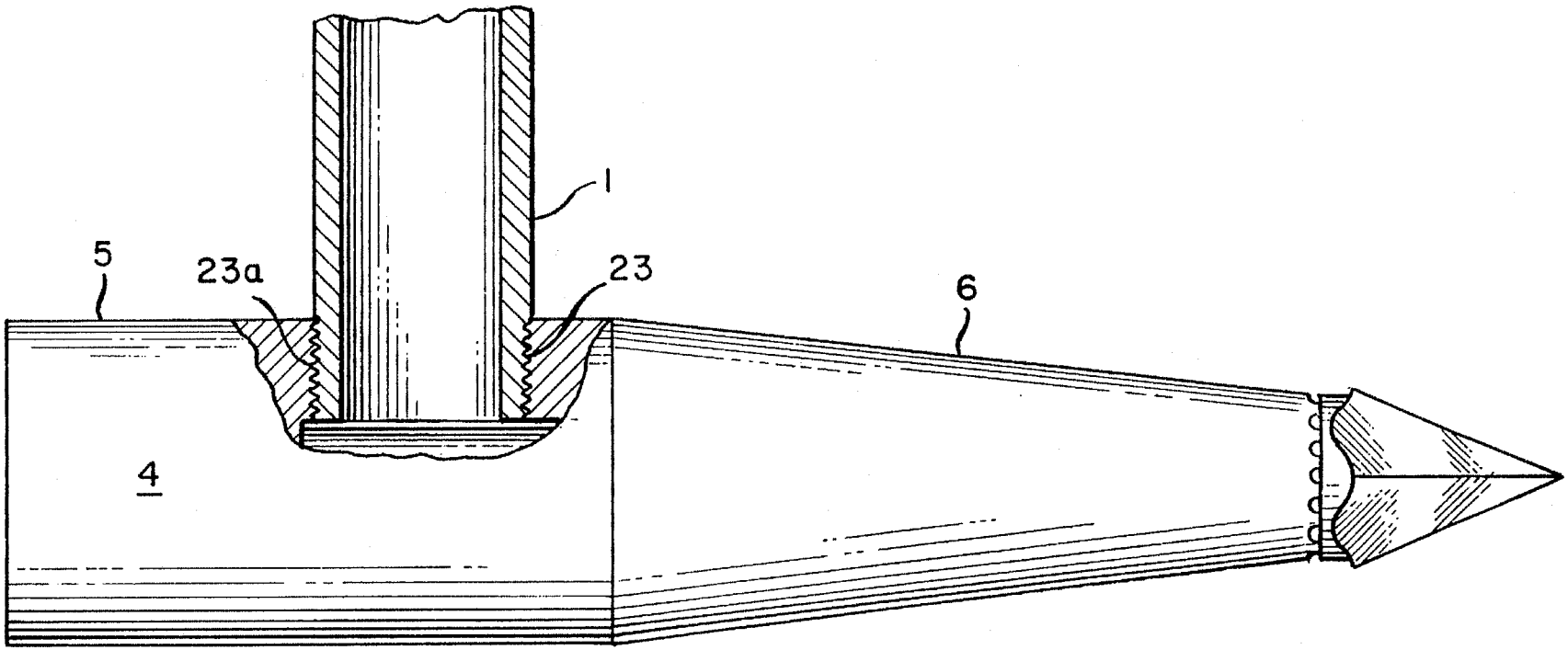
FIG. 10 is shows a threaded connection between the body and handle of the portable, hand-held fire fighting device of this invention.

In FIG. 10 an optional connection between handle 1 and head 5 is shown. In this particular embodiment, the handle will have threads 24 and **23*a* which will match threads within the head 5**.

DETAILS OF THE INVENTION

The portable, hand-held fire fighting device of this invention can be used with a large source of fire extinguishing agent. Water is most common since it is used to fight fires that may be contained within a confined and closed space as exemplified by small or compact buildings, motor homes, mobile homes, truck trailers or shipping containers, for example. Since the device of this invention is so portable and can be used by a single fire fighter, it can be carried to the site of the fire by any of the fire fighters involved. The hollow handle, head and discharge holes will be large enough to permit sufficient volumes of fire extinguishing agent to pass through and extinguish the fire. We envision that the size of the hose connectable to the handle of our device will be about 1 inch, although ¾ to 1½ inches is envisioned to be within the scope of this invention. The connection device attached to one end of the handle may be any of the conventional and well-known connection devices such as threaded, twist lock, zip nut, etc. Since the device of this invention is so easily used by a single fire fighter it may be present within any of the vehicles that respond to the scene of the fire.

Our device can be used in its many embodiments to fight fires contained within many enclosed and confined areas, as previously mentioned. We envision common structures made from conventional building materials such as wood, sheet metal or aluminum, among others. Our device is most useful in fighting fires contained within smaller structures such as mobile homes or trailers or metal sheds and the like where the penetrating end of the device is sufficient to punch through walls or roofs and the like. Optionally, our device may also be useful in combating motor vehicle fires where larger volumes of fire extinguishing agent are required or where the prior art element and its portable source of fire extinguishing agent are insufficient. However, by enlargement of the head element, our device could be made to punch through larger structures. In use, the fire fighter gets on the roof or up against a wall of the structure and swinging the device up over the head, punches downwardly so as to cause the penetrating element to go through the wall or roof, for example. A hose is then connected to the end of the handle that is gripped (shown as 2 in the figures ). Alternatively, the hose can be pre-conceived to the handle of our device prior to use as described above. The other end of the hose is connected to a large source of fire fighting agent such as a pumper or a booster tank vehicle, for example, or even a fire hydrant. When the fire fighting agent is caused to flow through the hose and the device of this invention, the agent will spray into the area involved in fire to assist or extinguish the fire. Since the device is portable, it is easily transported to the very source of the fire. Since the hole formed during the penetration of the wall, roof and the like, is small, and automatically plugged by the unique design of the tool, the chance for air to enter and enlarge the fire is almost non-existent. In addition, this small hole will minimize the dreaded "backdraft" which can cause injury and death to the fire fighter.

To fully utilize our device, sometimes the handle must form an angle other than 90° taken to a line drawn longitudinally down through the head of the device. This angle, which may be between 45° to 135° will assist in the overhead swing and insure that the head punches through the structure in a satisfactory manner and that the hands of the fire fighter are not involved with any fire or rigid structure and thus injured. The handle may be between 30 to 50 inches in length, but this is only preferred. A longer handle may be employed if this is convenient and matches the length desired by the fire fighter.

In yet another embodiment, the handle may have an angle other than 90° taken to a line drawn longitudinally down through the head of the device up to a point from between 5 to 15 inches from the head. Then, the remainder of the handle may be bent at an angle of 175° to 155°, or thereabouts, whereby the handle at that point is directly perpendicular to the line drawn longitudinally down through the head of the device. These angles and lengths are dependent upon the application and the convenience of the user and may vary somewhat therefrom.

The device of this invention may also be used in combating vehicle engine fires and the like. For example, where there are a plurality of vehicles and engines involved in fire, it may be more convenient to use the device of this invention rather than that described in our previous applications since this device can provide a greater supply of fire extinguishing agent. Additionally, the device of this invention may be present within the piece of fire apparatus that responds to a vehicle fire and thus be used to extinguish any fire contained therein.

In the manufacture of the portable, hand-held fire fighting device of this invention, many of the conventional, easily obtained materials may be used. For example, the body element which comprises a head with a tapered and flared end having a sharp, removable cutting element on one end thereof, may be made from any conventional metals. We prefer non-corrosive steels and in particular stainless steel since that material adds resistance to corrosion and considerable weight to the penetrating element itself. The cutting end is designed to pierce many conventional materials such as wood, sheet metal, aluminum, roofing materials, sheet rock and may also be made from any conventional, non-corrosive materials. The device of this invention should pierce cleanly through these materials leaving very little space for additional oxygen to enter the area involved in fire and increase the fire. The cutting element itself should be made from tool quality steel (prefer stainless steel) and may be heat treated to insure a hardness of Rockwell 30–50 to allow for durability. Since the cutting element can easily be removed from the head itself, it is easily replaced if it becomes damaged during use or can be easily removed to clean out the hollow interior of the body after fighting a fire. The sharpness of the cutting element can also be maintained by honing or grinding, for example.

The tip of the head is comprised of the removable cutting element which may be made with several faces to form a cutting tip, as shown in the drawings. We prefer that a point made from four faces is used. However, more or less faces may also be used within the ambit of this invention. The cutting element is held in place by any conventional holding means (e.g. by a threaded bolt which is placed down through the hollow head itself and connected into a shaft of the cutting element. Several flutes are present along this shaft. There are grooves cut within the tapered end of the interior of the head. These grooves will form discharge holes when matched up with the flutes and the collar of the cutting element when the two are mated. The grooves and flutes will form holes which will discharge fire extinguishing agent out over the top of the cutting tip. These holes will form a spray angle from about 45° to about 80° to the same line formed longitudinally down through the body element. There can be a plurality of these grooves and flutes. We prefer from three to six flues and six to sixteen grooves. The fire extinguishing agent will flow out as streams along this route, forming an umbrella-like spray of fire extinguishing agent to safely, quickly and effectively help extinguish the fire contained within the enclosed and contained area without exposing the fire fighter to smoke, flames, heat or gases.

The body element may be connected to the handle element by welding. Optionally, as shown in the drawings, the handle and head may be threaded to permit this connection. Welding is preferred since the element is more easily manufactured by this route and provides a greater degree of safety for the user. The connection mates the hollow portion of the handle with the hollow portion of the body and it is down this route that the fire extinguishing agent travels.

The hollow, linear handle element may also be made from many conventional materials. We prefer making this part of our device from stainless steel, although a simple steel pipe or heat resistive plastic may also be used. The body's head may have a diameter of from about two to three inches in order to permit the appropriate larger flow and volume of fire extinguishing agent. The diameter of the handle will be determined only by the requisite flow of fire extinguishing agent and the size that is conveniently gripped by the fire fighter. The handle is connected, as previously described, on one end to the penetrating head element. At the other end, there may be an optional gripping sleeve and there is present a hose connection device to permit the connection of a fire hose thereto. These are well-known connection devices and any of them may be mounted on this end of the handle. When using the device of this invention, the fire fighter swings the device over the head and punches down to permit penetration by the cutting tip and tapered end of the head through the wall or roof, for example. The fire fighter then makes up the connection, if the tool is not already pre-connected, between the hose connection on the end of the handle and the hose, which will have a matable connection thereon. The source of fire fighting agent is then turned on to permit a flow through the device and into the area which contains the fire. Since the device can be used by a single fire fighter, it is very handy and much safer and faster to use as compared to prior art elements. Additionally, the hole punched through the material which surrounds the area containing the fire is small and is automatically plugged by the tapered end of the device of this invention thus oxygen flow and drafts to the fire are restricted. Other prior art devices punch huge holes and oxygen may enter enlarging and feeding the fire. Other prior art devices are much larger and more cumbersome to use and require more than a single fire fighter to operate especially in confined areas.

As mentioned previously, the device of this invention can be used to fight fires that may be contained within truck trailers or containers and the like. Where these elements are closely stacked together, such as on a container ship, for example, the area between containers sometimes is very small. In this instance, there may not be enough room for the individuals fighting a fire that may occur to use the tool of this invention as just described, e.g. by swinging the device up over the head of the individual in order to puncture through a wall, roof or door, for example. In these instances, it is sometimes useful to use another fire fighting tool in conjunction with the device of this invention to gain access to the fire itself. For example, a fire ax or sledge or large hammer may be used to hit the top of the head 5 and thus force the cutting element 7 and some if not all of the tapered end 6 through the wall, roof or door of the container in which a fire has occurred. Thus, what we are describing is a process for using the tool or device of this invention in closed or cramped quarters in order to fight a fire contained within a confined space.

We claim:

1. A portable, hand-held fire fighting tool comprising a hollow, linear handle element having two ends, the first end having a hose connection attached thereto and the other end being connected to a penetrating body element, said body element comprising a head having a hollow interior, said head having a taped and flared end, said flared end having a sharp, removable cutting element attached thereto, said cutting element comprising a shaft insertable and connectable within said tapered and flared end, and a cutting tip having a beveled top and a sharp point extending out from said shaft, wherein when a line is drawn through the longitudinal axis of said penetrating body element, said line forms an angle of 45° to 135° to said handle element, said shaft of said cutting element having a series of flutes therein and said hollow, tapered and flared end of said body having a series of grooves therein, said flutes in said shaft of said cutting element forming a series of holes emanating from the top of said cutting tip when said cutting element is mated to said flared and tapered end of said hollow body of said head by inserting said shaft therein, said holes providing openings to the hollow interior of said body of said penetrating element, the hollow portion of said penetrating element being connected to said hollow handle element permitting a flow through said handle to the interior of said penetrating element and wherein said hollow handle has an inside diameter of at least one half inch.

2. The portable, hand-held fire fighting tool of claim 1 wherein said linear handle element has a length of between 30 to 50 inches and said angle formed by a line drawing through the longitudinal axis of said penetrating body element and said linear handle element is between 45° and 135°.

3. The portable, hand-held fire fighting tool of claim 1 wherein a fire hose having a length and two ends is connected to the hose connection of the linear handle and the other end is connected to a source of fire extinguishing agent.

4. The portable, hand-held fire fighting tool of claim 3 wherein said fire extinguishing agent is water and source is taken from the group consisting of a container, a fire truck and a fire hydrant.

5. The portable, hand held-fire fighting tool of claim 3 wherein when said hose is connected to said tool and to said source of fire extinguishing agent causing a flow through said hose and said tool, said fire extinguishing agent will disperse through said holes at an angle of 45° to 80°.

6. The portable, hand-held fire fighting tool of claim 1 wherein said handle has a bend formed at a distance of between 5 and 15 inches from said penetrating body element, said bend forming an angle of 175° to 155°.

7. The portable, hand-held fire fighting tool of claim 6 wherein said tool is made from the group consisting of steel and stainless steel.

8. The portable, hand-held fire fighting tool of claim 6 wherein said cutting tip is fashioned from four faces.

9. The portable, hand-held fire fighting tool of claim 6 wherein said hollow, linear handle is connected to said penetrating body element by welding.

10. The portable, hand-held fire fighting tool of claim 6 wherein said hollow, linear handle is threaded to said penetrating body element.

11. The portable, hand-held fire fighting tool of claim 6 wherein said means for attaching said removable, sharp, cutting element to said body element is a threaded bolt.

* * * * *